US008493278B2

(12) United States Patent
Lopez

(10) Patent No.: US 8,493,278 B2
(45) Date of Patent: Jul. 23, 2013

(54) ANTENNAS AND METHODS TO PROVIDE ADAPTABLE OMNIDIRECTIONAL GROUND NULLS

(75) Inventor: Alfred R. Lopez, Commack, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 342 days.

(21) Appl. No.: 12/992,900

(22) PCT Filed: Mar. 4, 2010

(86) PCT No.: PCT/US2010/026201

§ 371 (c)(1),
(2), (4) Date: Nov. 16, 2010

(87) PCT Pub. No.: WO2010/107593

PCT Pub. Date: Sep. 23, 2010

(65) Prior Publication Data

US 2011/0063171 A1 Mar. 17, 2011

Related U.S. Application Data

(60) Provisional application No. 61/160,489, filed on Mar. 16, 2009.

(51) Int. Cl.
*H01Q 21/20* (2006.01)

(52) U.S. Cl.
USPC ..... 343/799; 343/800

(58) Field of Classification Search
USPC ..... 343/799, 800, 820, 874; 342/368, 342/372
See application file for complete search history.

(56) References Cited

U.S. PATENT DOCUMENTS

| | | | | |
|---|---|---|---|---|
| 5,995,044 | A | 11/1999 | Kunysz et al. | |
| 6,201,510 | B1 | 3/2001 | Lopez et al. | |
| 6,724,840 | B1 | 4/2004 | Osofsky et al. | |
| 7,417,597 | B1 | 8/2008 | Lopez | |
| 8,049,667 | B2 * | 11/2011 | Lackey | 342/368 |

* cited by examiner

*Primary Examiner* — Hoang V Nguyen
(74) *Attorney, Agent, or Firm* — Kenneth P. Robinson; Daniel J. Long

(57) ABSTRACT

GPS reception on helicopters and ground vehicles may be subject to varying near-ground interference. A compact antenna includes vertically spaced arrays of radiating elements. The first array provides a basic reception pattern. The second array provides a pattern having a distinctive low elevation angle phase reversal. By combining signals for these patterns an antenna pattern with a low angle onmidirectional elevation null characteristic is provided to suppress near-ground interference. Prior to combining, signals from the second array may be modified in amplitude or phase, or both, on a semi-permanent basis, or may be adaptively modified on an active basis, in order to adjust the null characteristic. Antennas and methods are described.

14 Claims, 7 Drawing Sheets

GAIN (dBi) V. ELEVATION ANGLE (DEGREES)

GAIN (dBi) V. ELEVATION ANGLE (DEGREES)

ANTENNAS AND METHODS TO PROVIDE ADAPTABLE OMNIDIRECTIONAL GROUND NULLS

This invention relates to antennas and more particularly to antennas and methods suitable for reception of signals from Global Positioning System (GPS) satellites in the presence of near-ground interference as may occur, for example, with an antenna mounted on a moving vehicle.

BACKGROUND ART

The inventor's U.S. Pat. No. 7,417,597 describes GPS antenna systems providing a vertically steerable null for interference suppression in the context of received data accuracies suitable for airport operations in support of precision approach and landing guidance. While providing elevation nulling capabilities, such antenna systems are generally larger and more complex than would typically be appropriate for mounting on a moving truck or other vehicle.

In the case of GPS antennas for use on military and other vehicles, it is desirable that the antenna have the capability of generating an omnidirectional elevation null near the horizon (i.e., a ground null) to suppress interference from sources at or near ground level. As a vehicle traverses varying ground conditions and may be subject to varying interference sources, it may be particularly desirable to provide an omnidirectional elevation null pattern with adaptive properties responsive to the presence or absence of current interference effects.

It is, therefore, desirable to provide antennas having some or all of such null capabilities with wideband capability and in a small package suitable for use on vehicles, such as helicopters and trucks, for GPS or other applications.

SUMMARY OF THE INVENTION

In accordance with the invention, an embodiment of an antenna, to provide an omnidirectional elevation null pattern, includes the following. A cylindrical first structure has a vertical central axis and horizontal conductive lower and upper surfaces with a predetermined vertical separation. A first array of radiating elements is spaced around the axis and extends from one of the surfaces. A second array of radiating elements is spaced around the axis and extends from the other surface. An excitation configuration is coupled to the first array and arranged to provide at a first port a first signal representative of a reference antenna pattern and coupled to the second array and arranged to provide at a second port a second signal representative of an auxiliary antenna pattern having a low elevation phase reversal characteristic. A signal processing configuration is coupled to the first and second ports and configured to combine signals representative of the first and second signals to provide at an output port an output signal representative of an antenna pattern having an omnidirectional elevation null characteristic.

The signal processing configuration may be configured to couple the first signal to the output port (instead of the output signal provided by combining of signals) in the absence of reception of interference signals of amplitude exceeding a predetermined threshold.

In a first alternative embodiment the signal processing configuration is configured to combine the first and second signals, with one or both of the amplitude and phase of the second signal modified relative to the first signal to adjust the omnidirectional null characteristic. In a second alternative embodiment the signal processing configuration is configured to adaptively combine the signals representative of the first and second signals, with the signal representative of the second signal adaptively modified to reduce the amplitude of the output signal, thereby adaptively adjusting the omnidirectional elevation null characteristic.

In the antenna, the first and second arrays may each comprise four radiating elements and the excitation configuration may comprise:

a first beam former coupled to the first array and arranged to provide excitation of its four radiating elements of 0, 90, 180 and 270 degree respective phase to provide the first signal at the first port; and a second beam former coupled to the second array and arranged to provide excitation of its four radiating elements of 0, 90, 180 and 270 degree respective phase to provide the second signal at the second port.

An antenna in accordance with the invention may additionally include a cylindrical second structure having a conductive surface, extending downward below the lower surface of the first structure and having a diameter nominally one-quarter of the diameter of the cylindrical first structure.

Also in accordance with the invention, a method, for suppressing near-ground interference, may include the steps of:

(a) providing a first signal received via a first array of radiating elements excited to provide a reference antenna pattern;

(b) providing a second signal received via a second array of radiating elements excited to provide an auxiliary antenna pattern having a low elevation phase reversal characteristic;

(c) providing a signal representative of the second signal with one or both of amplitude and phase modifications relative to the first signal; and (d) combining the signal representative of the second signal with a signal representative of the first signal to provide an output signal representative of signal reception via an antenna pattern having an omnidirectional elevation null characteristic.

The method may additionally include the step of:

(e) in the absence of interference signals exceeding a predetermined threshold level, utilizing the first signal as an output signal, instead of the output signal of step (d).

Step (c) of the method may comprise:

(c) providing a signal representative of the second signal with fixed modifications to its amplitude and phase relative to the first signal.

Step (c) may alternatively comprise:

(c) providing a signal representative of the second signal adaptively modified to reduce the amplitude of the output signal provided in step (d), thereby adaptively adjusting the omnidirectional elevation null characteristic.

For a better understanding of the invention, together with other and further objects, reference is made to the accompanying drawings and the scope of the invention will be pointed out in the accompanying claims.

MODES FOR CARRYING OUT THE INVENTION

Figure 1:
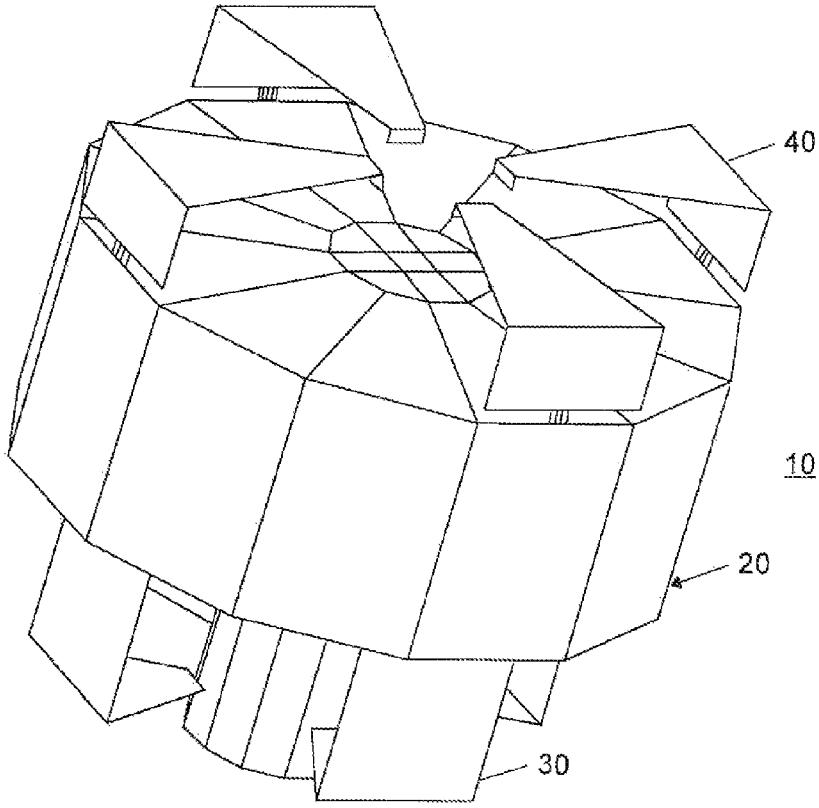
FIG. 1 is a perspective view.
Figure 2:
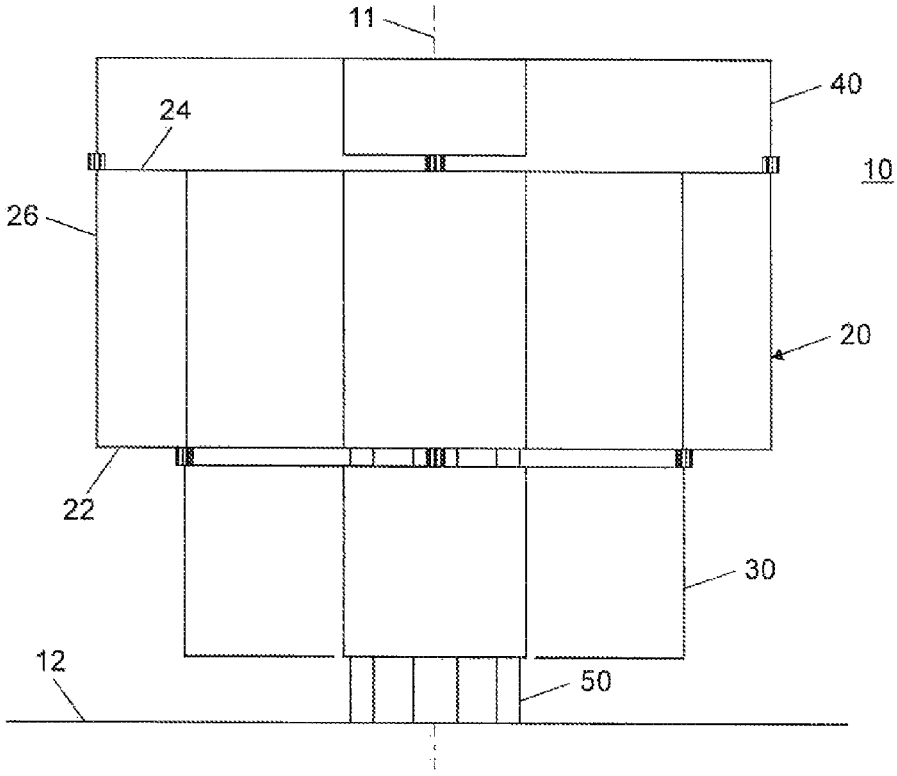
FIGS. 2, 3 and 4 are respective side, top and bottom views of an embodiment of an antenna utilizing the invention.
Figure 3:
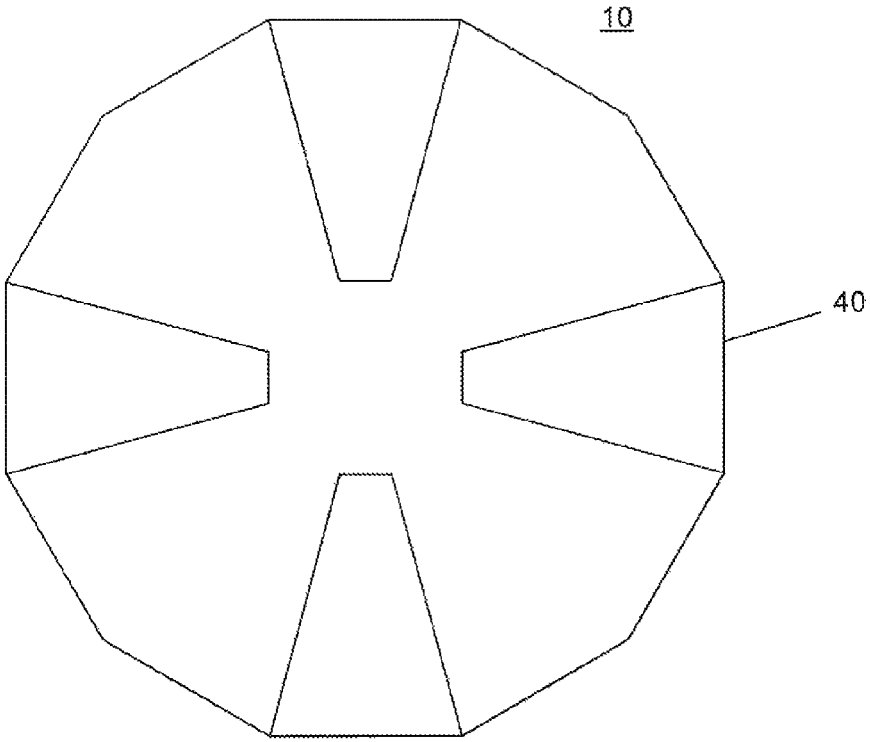
Figure 4:
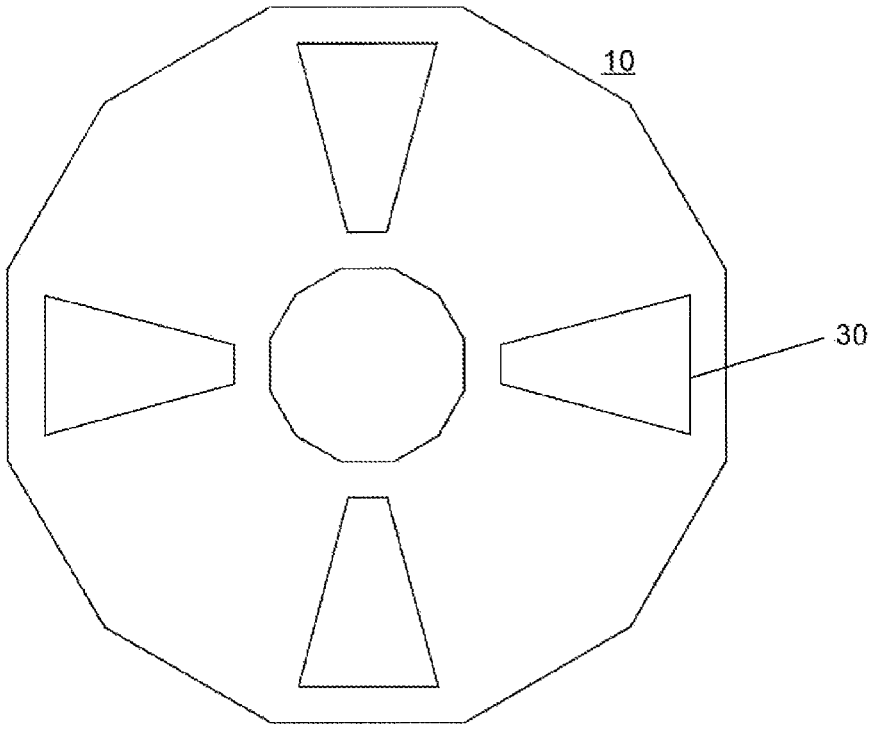

FIGS. 1, 2, 3 and 4 are respectively a perspective view and side, top and bottom views of an antenna 10 in accordance with a presently preferred embodiment of the invention. As will be described further, this embodiment is configured to provide a reference antenna pattern with a near constant gain over the upper hemisphere and also provide an antenna pattern having an omnidirectional elevation null (i.e., a ground null) characteristic, which may be arranged to be adaptively adjusted. The latter pattern is provided by combinational use of an auxiliary pattern having a distinctive low elevation phase reversal characteristic.

In this embodiment, antenna 10 has a center axis 11 and includes a cylindrical first structure 20, a first bottom array of four bottom radiating elements, of which element 30 is typical, a second top array of four top radiating elements, of which element 40 is typical, and a cylindrical second structure 50. In use, the antenna is preferably positioned above a conductive ground plan represented at 12.

First structure 20 is shown as a twelve-sided cylindrical structure having horizontal conductive lower and upper surfaces 22 and 24 supported with a predetermined vertical separation by side portion 26. Such separation may nominally be one-quarter wavelength at an operating frequency. While shown for purposes of illustration as being of cylindrical form of twelve-sided cross-section, structures 20 and 50 may preferably be of circular cross-section in production antennas. Lower and upper surfaces 22 and 24, as well as side portion 26, may be of metal or other construction to provide a conductive surface exposed or covered with transmissive material, so as to provide an enclosed shielded inner space that may house other antenna components. First structure 20 may have a diameter of nominally one-half wavelength at an operating frequency. The term "an operating frequency' is defined as a frequency in an operating bandwidth of the antenna.

As shown, bottom radiating element 30 and the three other radiating elements of the first array are spaced around axis 11 and extend below the lower surface 22. The top array, including radiating element 40, has four radiating elements spaced around axis 11 and extending above the upper surface 24. In this embodiment each of the radiating elements has the form of a bent monopole having a horizontally extending first portion extending from a vertically extending second portion which is supported from first structure 20 in any suitable well known manner, with a conductive path extending inside structure 20 without electrical contact with structure 20.

As shown, antenna 10 includes a cylindrical second structure 50 having a conductive surface, extending downward below lower surface 22 of first structure 20 and having a diameter smaller than that of first structure 20. Second structure 50 may be fabricated of metal or other construction with a conductive surface exposed or covered with transmissive material, may be arranged to enable mounting to a vehicle or other structure with a reflective ground plane provided separately or by a vehicle surface and may be arranged to enclose electrical cabling connected to the antenna. There may be an opening into the interior of second structure 50 from the interior of first structure 20. Second structure 50 thus provides a cylindrical element cooperating with the bottom array of radiating elements to enable provision of a desired reference antenna pattern, such as will be described. Structure 50, in a presently preferred embodiment, may have a diameter nominally one-quarter the diameter of the first structure 20. For present purposes, the term "nominally" is defined as a value within plus or minus 15 percent of a stated value. While the FIG. 1 antenna is illustrated with the cylindrical second structure 50 and the first array (including element 30) at the bottom, in some applications the antenna may be vertically rotated so that antenna portions corresponding to those elements are at the upper portion of the antenna.

Figure 5:
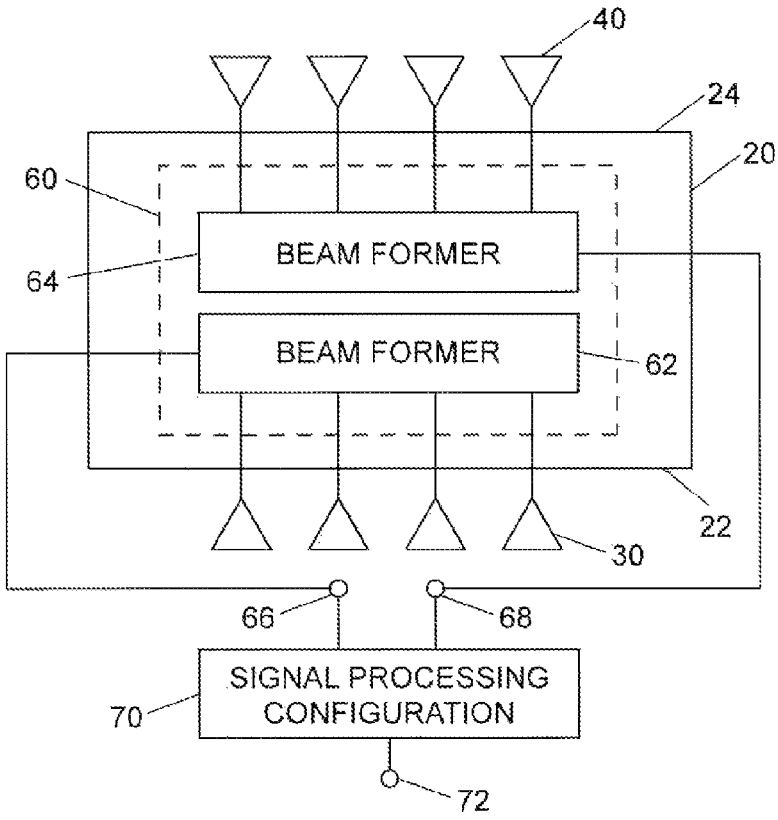
FIG. 5 is a diagram of excitation and signal processing configurations usable in the FIG. 1 antenna.
Figure 7:
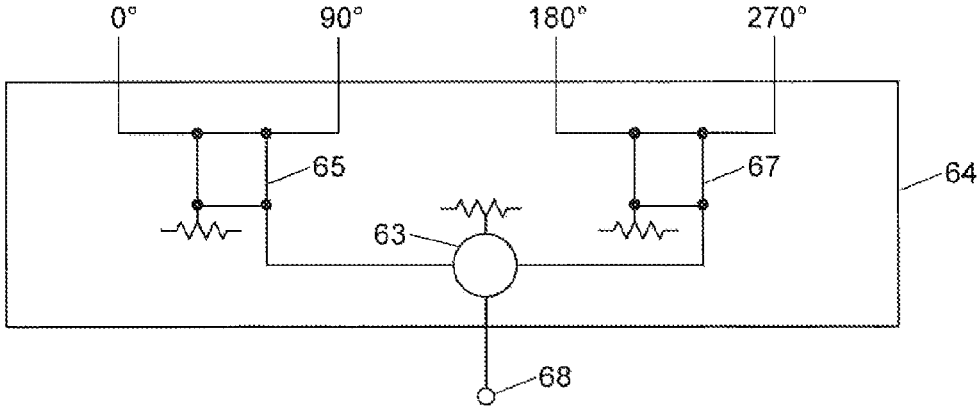
FIG. 7 is a diagram of a form of beam former circuit usable in the excitation configuration of FIG. 5.

Referring now to FIG. 5, antenna 10 further includes excitation configuration 60, shown positioned within first structure 20, and signal processing configuration 70, which may also be positioned within first structure 20 or externally. In this embodiment, excitation configuration 60 includes first and second beam formers 62 and 64, respectively coupled to the radiating elements of the bottom and top arrays. Each beam former may employ a known form of circuit (such as shown in FIG. 7, for example) to provide excitation of the four radiating elements of the relevant array of 0, 90, 180 and 270 degree respective phase. Beam former 62 is thus effective to provide a received first signal at first port 66 and beam former 64 provides a received second signal to second port 68, during operation of the antenna.

Figure 6A:
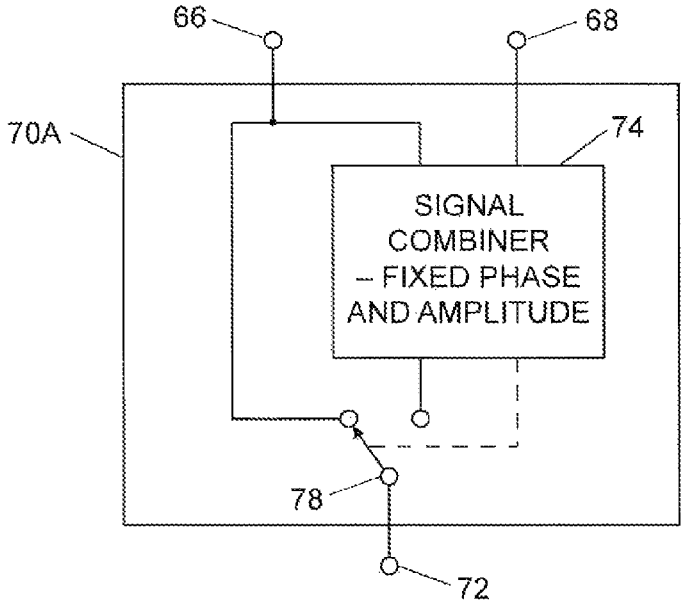
FIGS. 6A, 6B and 6C are diagrams of alternative forms of the signal processing configuration of FIG. 5.
Figure 6B:
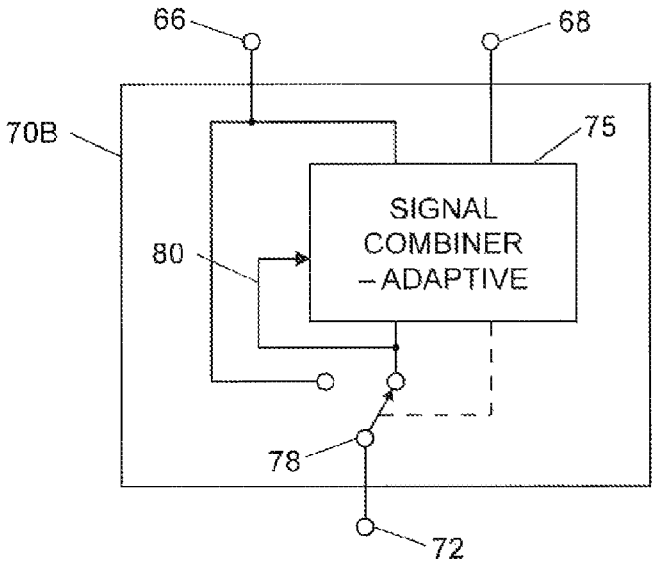
Figure 6C:
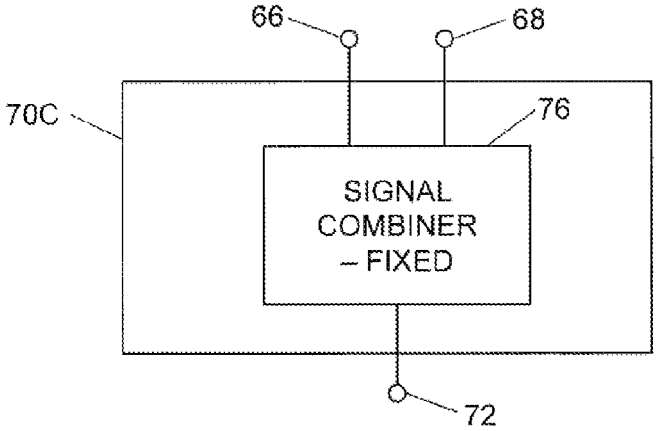

Signal processing configuration 70, as shown in FIG. 5, is coupled to the first and second signal ports 66 and 68 and configured to combine signals representative of received first and second signals to provide at output port 72 an output signal representative of an antenna pattern having an omnidirectional elevation null characteristic as will be further described. While any suitable signal processing techniques may be employed by skilled persons in implementing the invention, known types of signal processing algorithms may be arranged to be responsive to the signals from the first and second signal ports 66 and 68 to provide optimized output signals at port 72 which are usable as input signals to GPS receivers under clear signal conditions, interference situations and varying conditions. Thus, as will be discussed, signal processing configuration 70 may be arranged to provide at port 72, under clear signal conditions, the second signal from port 66 and, under interference conditions, a combination of the signals from ports 66 and 68, either on a fixed combination basis or on an adaptive basis. Further, the signal at port 72 may be arranged to change dependent upon the actual clear or interference conditions currently experienced. FIGS. 6A, 6B and 6C provide three simplified illustrative block diagrams of signal processing configuration 70 of FIG. 5, which may be implemented by skilled persons in any suitable manner, as discussed above.

FIG. 6A illustrates an embodiment 70A of the signal processing configuration 70 which is configured to additively combine, in signal combiner 74, the first and second signals from first and second signal ports 66 and 68 to form a combined signal. Prior to combining the signals, the second signal may be modified in one or both of amplitude and phase relative to the first signal, in order to adjust or improve characteristics of the null in view of operating conditions pertinent to particular or general use of an antenna. For example, in one preferred embodiment the second signal was modified to have a nominally 2.2 dB greater amplitude and a negative phase shift of nominally 20 degrees relative to the first signal. Combination of the first signal with this modified second signal was effective to provide a combined signal representative of an omnidirectional elevation null pattern illustrated in, and to be discussed with reference to, FIG. 8.

In operation of the 70A embodiment of the signal processing configuration, in the absence of reception of significant interference signals, the first signal from the first signal port 66 (representing the reference pattern) is coupled, via switching device 78, to output port 72. The presence of significant interference signals may, for example, be indicated when the level of the first signal from signal port 66 exceeds a predetermined threshold amplitude selected to represent an expected level of incoming GPS signals, thereby indicating the inclusion in the first signal of a higher amplitude interference signal. Responsive to such a threshold-exceeding signal coupled to it, signal processing configuration 70A, by operation of signal combiner 74, is arranged to both (i) combine the first and second signals, with suitable fixed modification of the amplitude and/or phase of the second signal relative to the first signal (such as noted above, for example) to form a combined signal representing an antenna pattern with omnidirectional elevation null characteristic and (ii) activate a switching function represented at 78, to couple that combined signal to output port 72 as the output signal. For GPS reception, the signal at port 72 is suitable for coupling to a GPS receiver. The bottom array first signal at port 66, and the top array second signal at port 68 and the resultant combined signal at output port 72 will be discussed further with reference to FIG. 8.

FIG. 6B illustrates an embodiment 70B of the signal processing configuration which is configured to combine signals representative of the first and second signals at signal ports 66 and 68, with the signal representative of the second signal adaptively modified, for example, to substantially reduce or minimize the amplitude of the combined signal (to be coupled to output port 72). In FIG. 70B, signal combiner 75 may be configured to implement known adaptive techniques to derive from the second signal at signal port 68 a modified second signal with particular phase and amplitude characteristics which can be employed to substantially minimize the amplitude of the combined signal as indicated above. Since a significant or reception-disruptive interference signal can be expected to be of greater or much greater amplitude than a desired GPS signal, adjusting a vertical null to minimize the output signal can represent the adjustment of the null to effectively center it at or near the elevation angle of incidence of the incoming interference signal, resulting in significant interference reduction in the output signal. Thus, by using known types of adaptive processing techniques and comparing the input from port 66 to signal combiner 75 and the feed back of the output signal at conductor 80, such signal amplitude minimization can be adaptively implemented. In operation of signal combiner 75, when adaptive processing is initiated in response to an above-threshold signal from port 66, signal combiner 75 also activates switching device or function 78, so that the adaptive output signal is coupled to output port 72 instead of the unmodified first signal from signal port 66, which is coupled to the output port in the absence of significant interference. For some applications, signal processing configuration 70B could be arranged to provide either adaptive processing or fixed combining (as in 70A) to provide most effective interference suppression.

FIG. 6C illustrates an embodiment 70C of the signal processing configuration which is configured to provide an antenna pattern having a fixed omnidirectional elevation null characteristic at all times, regardless of whether interference is present. Signal combiner 76 may be configured to implement a combination of the first and second signals as implemented in signal combiner 74 of FIG. 6A, while operating without any switching between the combined output signal and the unmodified first signal as implemented by signal combiner 74 of FIG. 6A (i.e., the function of switch 78 is absent). Thus in some applications the capabilities of configuration 70A may be appropriate, in other applications the adaptive capabilities of configuration 70B may be appropriate and in other applications the fixed ground null capabilities of configuration 70C may be appropriate or adequate, as may be determined by skilled persons in view of the particular application, the level of performance desired and other relevant considerations. These configurations are illustrated in simplified form for purposes of description; the particular form of a configuration suitable for a particular application may be determined by skilled persons once having an understanding of the invention and may employ suitable processing algorithms as discussed above.

FIG. 7 shows a circuit suitable to provide the described capabilities of each of beam formers 62 and 64 of FIG. 5. As shown in this example, a signal coupled to signal port 68 is divided into two equal opposite phase signals by hybrid junction 63, which signals are coupled to directional couplers 65 and 67 arranged to provide four equal outputs of the relative 0, 9, 180 and 270 degree phases indicated, for coupling to the four radiating elements of the top array. While signal transmission terminology is used for convenience, it will be understood that antenna components operate reciprocally to provide array excitation to enable a received first signal to be provided at first port 66 and a received second signal to be provided at second port 68 as previously described.

Figure 8:
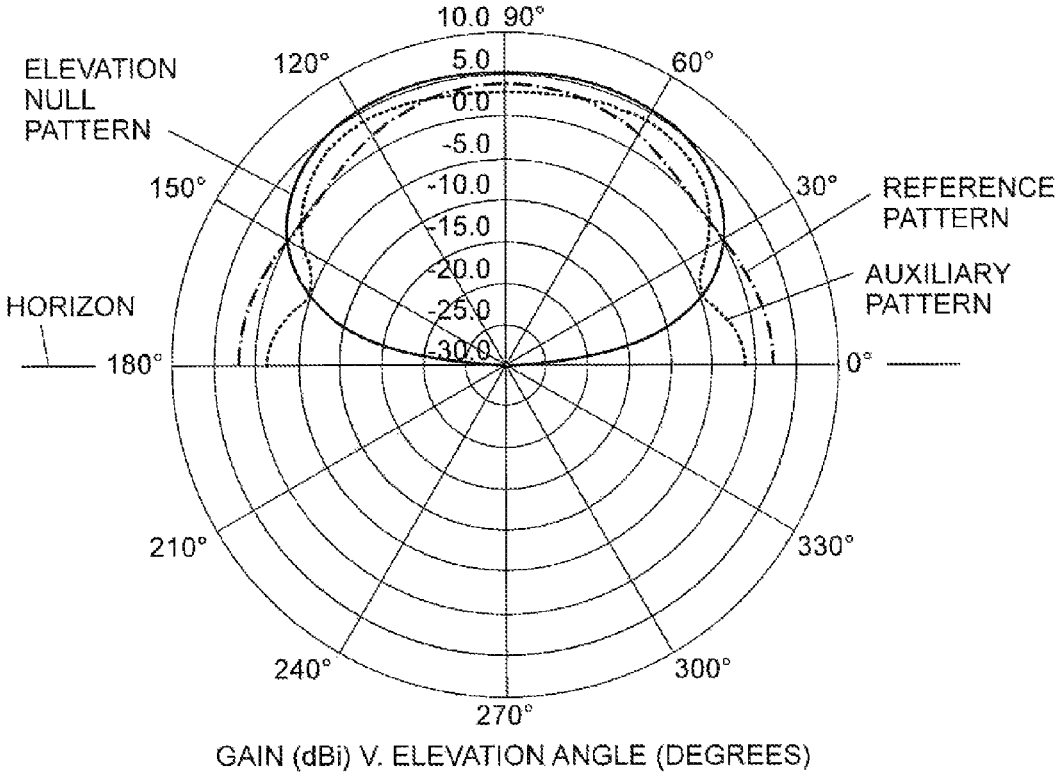
FIG. 8 presents gain versus elevation data for reference, auxiliary and elevation null antenna patterns.
Figure 9:
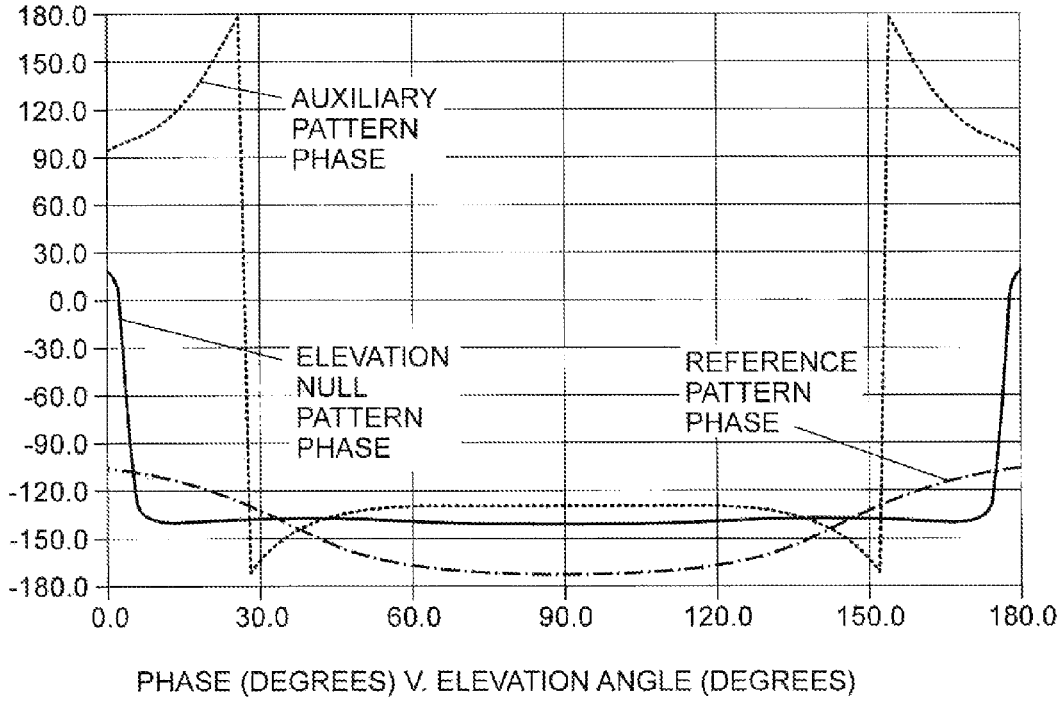
FIG. 9 presents phase versus elevation data for the antenna patterns of FIG. 8, illustrating the low elevation phase reversal characteristic of the auxiliary antenna pattern.

FIG. 8 shows computer generated antenna patterns at 1228 MHz for the FIG. 1 antenna mounted over an infinite conductive ground plane. Closely similar patterns at 1575 MHz confirm wideband characteristics of the antenna. As shown in FIG. 8, the bottom array of radiating elements provides a pattern (i.e., the reference pattern) with near uniform gain (dBiRHCP) over the upper hemisphere. The top array provides a pattern (i.e., the auxiliary pattern) of less uniform gain and having a very distinctive phase characteristic, which will be referred to as a low elevation phase reversal characteristic. As shown in the phase versus elevation diagrams of FIG. 9, for elevation angles below 30 degrees elevation the phase of the auxiliary pattern for the upper array reverses phase from negative to positive (i.e., for the portion of the auxiliary pattern below 30 degrees elevation as shown in FIG. 8). As a result, when in the operation of signal combiner 74 of FIG. 6A the second signal (auxiliary pattern signal) is additively combined with the first signal (reference pattern signal) the net antenna pattern low angle gain is reduced, producing the dramatic ground null below 30 degrees elevation as shown in the elevation null pattern of FIG. 8, which is provided by the output signal at output port 72 of FIG. 6A, representing an antenna pattern having an omnidirectional elevation null characteristic. FIG. 9 shows computer generated phase data for the FIG. 1 antenna at 1228 MHz. Phase data at 1575 MHz is closely comparable. As referred to above, in combining the second signal (auxiliary pattern) with the first signal (reference pattern) in signal combiner 74 of FIG. 6A, the amplitude and phase, or both, of the second signal may be modified relative to the first signal (e.g., second signal 2.2 dB greater amplitude and 20 degrees negative phase or phase lag) for purposes of null optimization. These values, as selected by skilled persons for a particular application, may then be used on a fixed (e.g., permanent) basis in operation of signal combiner 74 of FIG. 6A. For signal combiner 75 of FIG. 6B known techniques of adaptive processing may be implemented to adjust parameters of the second signal (or both the first and second signals in some implementations) prior to combining signals representative of the second and first signals, in order to be responsive to currently experienced interference conditions. Signal combiner 76 of FIG. 6C may, for example, be implemented in the same manner as described for signal combiner 74 of FIG. 6A (excluding the switching function as previously described).

Figure 10:
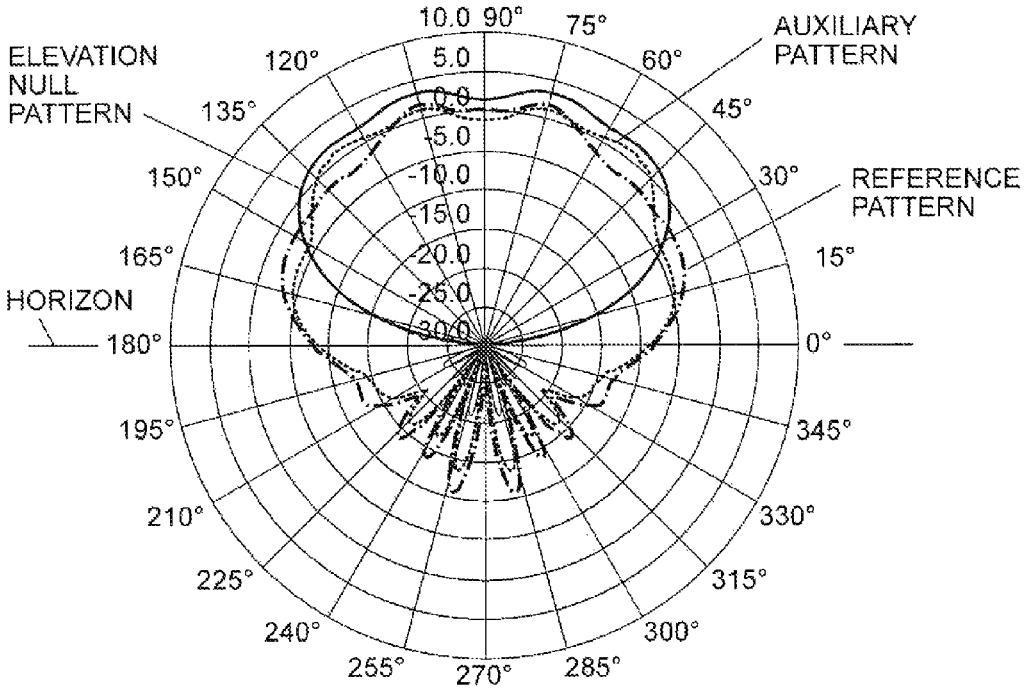
FIG. 10 presents gain versus elevation patterns for the antenna mounted on a 36 inch ground plane.

FIG. 10 shows computer generated antenna patterns at 1228 MHz for the FIG. 1 antenna mounted above a reflective ground plane of 36 inch diameter. Patterns at 1575 MHz are closely similar, so as to enable effective performance at different GPS frequencies. In this example, the second signal (auxiliary pattern) from the second port 68 is modified in amplitude by negative 2.5 dB and in phase by negative 27 degrees before combining with the first signal (reference pattern) from the first port 66, to form the output signal (elevation null pattern) which is coupled to output port 72.

Figure 11:
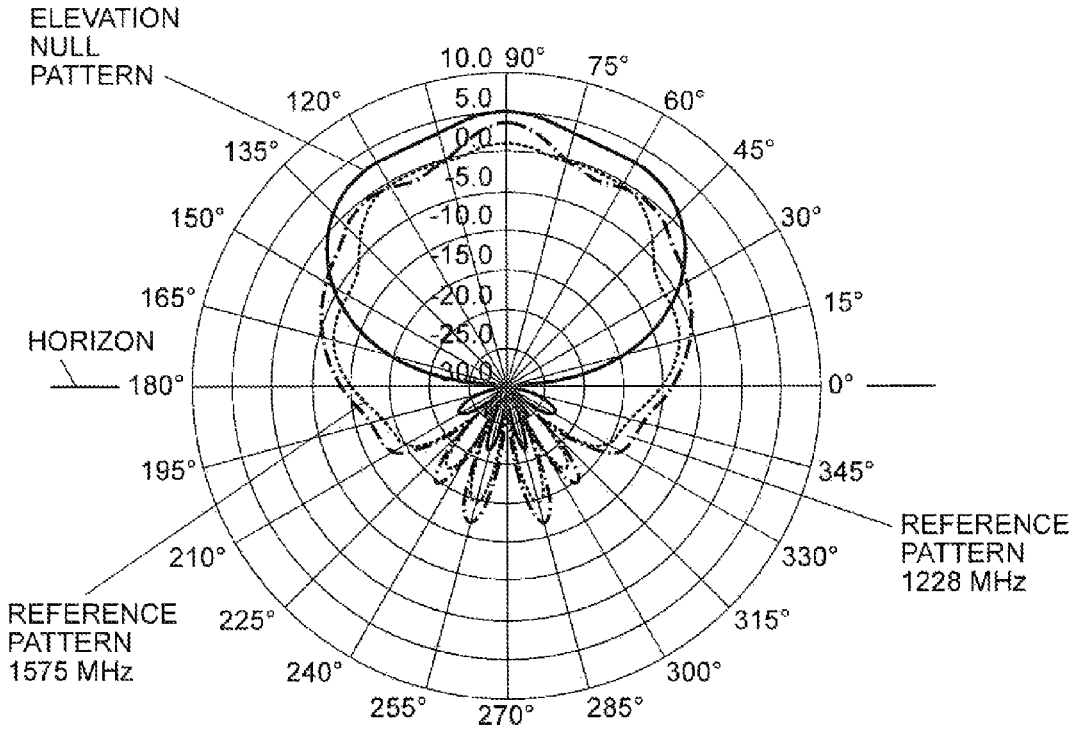
FIG. 11 presents gain versus elevation data for the reference pattern at two GPS frequencies.

FIG. 11 shows computer generated antenna patterns at 1228 MHz and 1575 MHz for the reference pattern. The elevation null pattern at 1575 MHz is also shown (corresponding pattern at 1228 MHz is included in FIG. 10). As illustrated, an antenna pursuant to the invention (e.g., the FIG. 1 antenna) enables the primary pattern utilized in the absence of interference to be optimized as to coverage provided for normal operation. Inherent lower gain near the horizon provides some level of ground multipath interference suppression by the primary pattern alone. The FIG. 11 patterns represent near ideal patterns for GPS reception at both frequencies. For FIG. 11 at 1228 MHz, for example, the antenna gain values (dBiRHCP) at low elevation angles in this example are as follows: gain −9.5 dBi at zero degrees, gain −6.8 dBi at 10 degrees, gain −3.6 dBi at 20 degrees and gain −0.5 dBi at 30 degrees, for reception of GPS signals of right hand circular polarization.

Figure 12:
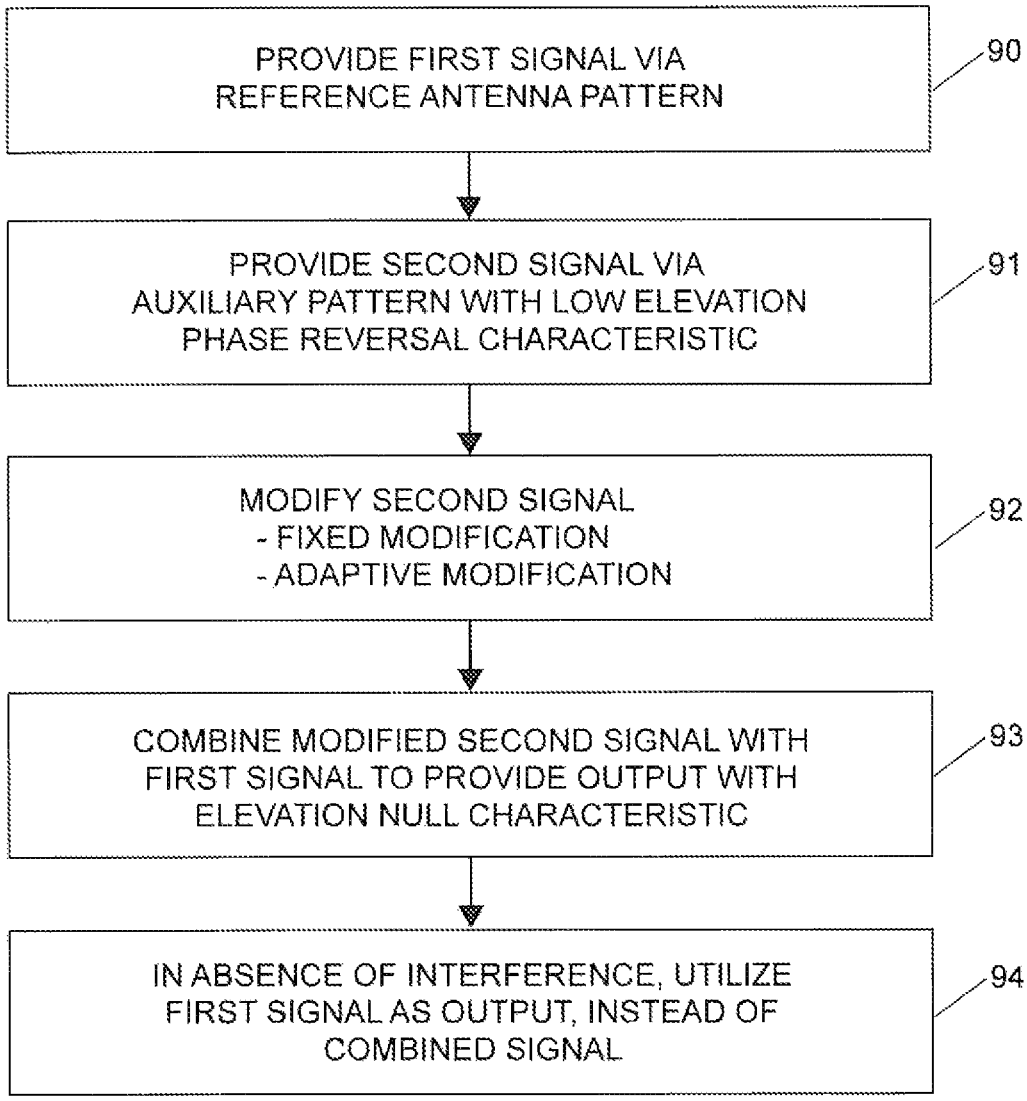
FIG. 12 is a diagram of a method pursuant to the invention.

Consistent with the foregoing, with reference to FIG. 12 a method for suppressing near-ground interference may comprise the following steps:

At 90, providing a first signal received via a first array of radiating elements excited to provide a reference antenna pattern.

At 91, providing a second signal received via a second array of radiating elements excited to provide an auxiliary pattern having a low elevation phase reversal characteristic.

At 92, providing a signal representative of the second signal with one or both of amplitude and phase modifications relative to the first signal, At 93, combining the signal representative of the second signal with a signal representative of the first signal to provide an output signal representative of reception via an antenna pattern having an omnidirectional elevation null characteristic.

At 94, in the absence of interference signals exceeding a predetermined threshold level, utilizing the first signal as the output signal.

In view of the preceding discussion of use of adaptive processing, the step at 93 may alternatively comprise:

providing a signal representative of the second signal adaptively adjusted to reduce or minimize the amplitude of the output signal provided at 93, thereby adaptively adjusting the omnidirectional elevation null characteristic. Such adaptive adjustment may effectively be carried out for reception at a particular frequency of interest in a specific implementation of the invention.

By way of example, for a particular design of an antenna of the form shown in FIG. 1, for GPS reception, approximate antenna dimensions were as follows, for example.

antenna width: 4 inches
antenna height: 4 inches
structure 20, height: 1.5 inches
monopole 30, height: 0.6 inches
monopole 30, horizontal length: 1.2 inches
monopole 40, height: 1.2 inches
monopole 40, horizontal length: 1 inch In the FIG. 1 antenna configuration, the bent monopole elements are supported and spaced from the conductive upper and lower surfaces of structure 20 by devices providing insulated feed-through conductors to internally positioned beam formers of FIG. 5. The signal processing configuration 70 may be positioned internally or elsewhere, with output cabling provided through the second cylindrical structure 50, which may be arranged to enable suitable mounting of the antenna on a vehicle surface or other surface acting as a ground plane. Contained within a basic 4 inch high by 4 inch diameter package, the antenna may additionally include a protective radome of suitable transmissive properties for weather and damage protection.

While there have been described currently preferred embodiments of the invention, those skilled in the art will recognize that other and further modifications may be made without departing from the invention and it is intended to claim all modifications and variations as fall within the scope of the invention.

What is claimed is:

1. An antenna, to provide an omnidirectional elevation null pattern, comprising:

a cylindrical first structure having a vertical central axis and horizontal conductive lower and upper surfaces having a predetermined vertical separation;

a first array of radiating elements spaced around said axis and extending from one of said surfaces;

a second array of radiating elements spaced around said axis and extending from the other said surface;

an excitation configuration coupled to said first array and arranged to provide at a first port a first signal representative of a reference antenna pattern and coupled to said second array and arranged to provide at a second port a second signal representative of an auxiliary antenna pattern having a low elevation phase reversal characteristic; and a signal processing configuration coupled to said first and second ports and configured to combine signals representative of said first and second signals to provide at an output port an output signal representative of an antenna pattern having an omnidirectional elevation null characteristic.

2. The antenna as in claim 1, wherein in the absence of reception of interference signals of amplitude exceeding a predetermined threshold, said signal processing configuration is configured to couple said first signal to said output port, instead of said output signal provided by combining of signals.

3. The antenna as in claim 1, wherein said signal processing configuration is configured to combine said first and second signals, with one or both of the amplitude and phase of the second signal modified relative to the first signal to adjust said omnidirectional null characteristic.

4. The antenna as in claim 1, wherein said signal processing configuration is configured to combine said signals representative of the first and second signals, with said signal representative of the second signal adaptively modified to reduce the amplitude of said output signal, thereby adaptively adjusting said omnidirectional elevation null characteristic.

5. The antenna as in claim 1, wherein the first and second arrays each comprise four radiating elements and said excitation configuration comprises:

a first beam former coupled to said first array and arranged to provide excitation of its four radiating elements of 0, 90, 180 and 270 degree respective phase to provide said first signal at said first port; and a second beam former coupled to said second array and arranged to provide excitation of its four radiating elements of 0, 90, 180 and 270 degree respective phase to provide said second signal at said second port.

6. The antenna as in claim 5, wherein said signal processing configuration is configured to combine said first and second signals, with one or both of the amplitude and phase of the second signal modified relative to the first signal to adjust said omnidirectional null characteristic.

7. The antenna as in claim 6, wherein in the absence of reception of interference signals of amplitude exceeding a predetermined threshold, said signal processing configuration is configured to couple said first signal to said output port, instead of said output signal provided by combining of signals.

8. The antenna as in claim 5, wherein said signal processing configuration is configured to combine said signals representative of the first and second signals, with said signal representative of the second signal adaptively modified to reduce the amplitude of said output signal, thereby adaptively adjusting said omnidirectional elevation null characteristic.

9. The antenna as in claim 8, wherein in the absence of reception of interference signals of amplitude exceeding a predetermined threshold, said signal processing configuration is configured to couple said first signal to said output port, instead of said output signal provided by combining of signals.

10. The antenna as in claim 1, wherein said antenna additionally comprises:

a cylindrical second structure having a conductive surface, extending downward below said lower surface of said first structure and having a diameter nominally one-quarter of the diameter of said cylindrical first structure;

and wherein the diameter of said first structure is nominally one-half of an operating wavelength.

11. The antenna as in claim 10, wherein said first array comprises four bent monopoles each having a vertical first portion and a second portion extending horizontally toward said second structure.

12. The antenna as in claim 1, wherein said first array comprises four bent monopole radiating elements extending below said lower surface and said second array comprises four bent monopole radiating elements extending above said upper surface of the first structure.

13. The antenna as in claim 1, wherein the lower and upper surfaces of said first structure have a vertical separation of nominally one-quarter of an operating wavelength.

14. The antenna as in claim 1, wherein said signal processing configuration is configured to additively combine said first, and second signals, with said second signal having a change in its amplitude and a phase shift relative to said first signal to adjust said omnidirectional elevation null characteristic.

* * * * *